US010629345B2

(12) United States Patent
Sagawa et al.

(10) Patent No.: US 10,629,345 B2
(45) Date of Patent: Apr. 21, 2020

(54) PRODUCTION METHOD OF RARE EARTH SINTERED MAGNET AND PRODUCTION DEVICE USED IN THE PRODUCTION METHOD

(71) Applicant: NDFEB Corporation, Kyoto-shi, Kyoto (JP)

(72) Inventors: Masato Sagawa, Kyoto (JP); Shinichi Hayashi, Kyoto (JP)

(73) Assignee: NDFEB CORPORATION, Kyoto-shi, Kyoto (JP)

( * ) Notice: Subject to any disclaimer, the term of this patent is extended or adjusted under 35 U.S.C. 154(b) by 1137 days.

(21) Appl. No.: 14/893,707

(22) PCT Filed: Sep. 18, 2015

(86) PCT No.: PCT/JP2015/076676
§ 371 (c)(1),
(2) Date: Nov. 24, 2015

(87) PCT Pub. No.: WO2016/047593
PCT Pub. Date: Mar. 31, 2016

(65) Prior Publication Data

US 2016/0293306 A1 Oct. 6, 2016

(30) Foreign Application Priority Data

Sep. 28, 2014 (JP) ..... 2014-197688
Sep. 29, 2014 (JP) ..... 2014-197898

(51) Int. Cl.
*B22F 3/03* (2006.01)
*B22F 9/04* (2006.01)
(Continued)

(52) U.S. Cl.
CPC ..... *H01F 1/0577* (2013.01); *B22F 1/0011* (2013.01); *B22F 1/0062* (2013.01);
(Continued)

(58) Field of Classification Search
USPC ..... 148/101
See application file for complete search history.

(56) References Cited

U.S. PATENT DOCUMENTS 5,725,816 A 3/1998 Sagawa et al.
2007/0245851 A1* 10/2007 Sagawa ..... B22F 3/1021 75/10.67
2012/0107433 A1 5/2012 Sagawa

FOREIGN PATENT DOCUMENTS

CN 1098790 C 1/2003
CN 102422367 A 4/2012
(Continued)

OTHER PUBLICATIONS

Extended European Search Report dated Jun. 22, 2018, issued in Patent Application No. 15793661.8 (PCT/JP2015076676).
(Continued)

*Primary Examiner* — Brian D Walck
(74) *Attorney, Agent, or Firm* — Westerman, Hattori, Daniels & Adrian, LLP

(57) ABSTRACT

There is provided a production method and a production device for producing each of the rare earth sintered magnet sintered bodies without carrying a mold in a sintering furnace. The method includes feeding an alloy powder into a mold having side walls divided into two or more sections; filling the alloy powder into the mold to prepare a filled molded-body; orienting the alloy powder in the filled molded-body by applying a magnetic field to the filled molded-body to prepare an oriented filled-molded-body; detaching the side walls of the mold from the oriented filled-molded-body and retrieving the oriented filled-molded-body from the mold; and sintering the retrieved oriented filled-molded-body. The filling step and the orienting step are performed at different locations. A pulsed magnetic field can be applied in the orienting step and inside
(Continued)

of the mold can be partitioned into a plurality of cavities by partitions.

18 Claims, 6 Drawing Sheets

(51) Int. Cl.

| | |
|---|---|
| ***H01F 1/057*** | (2006.01) |
| ***C22C 38/00*** | (2006.01) |
| ***H01F 1/08*** | (2006.01) |
| ***H01F 41/02*** | (2006.01) |
| ***B30B 11/00*** | (2006.01) |
| ***B30B 15/30*** | (2006.01) |
| ***B30B 11/02*** | (2006.01) |
| ***B30B 15/02*** | (2006.01) |
| ***C22C 19/07*** | (2006.01) |
| ***C22C 28/00*** | (2006.01) |
| ***B22F 1/00*** | (2006.01) |
| ***B22F 3/00*** | (2006.01) |
| ***B22F 3/10*** | (2006.01) |
| ***C22C 38/06*** | (2006.01) |
| ***C22C 38/10*** | (2006.01) |
| ***C22C 38/16*** | (2006.01) |
| ***H01F 1/055*** | (2006.01) |

(52) U.S. Cl.

CPC ..... *B22F 3/003* (2013.01); *B22F 3/004* (2013.01); *B22F 3/03* (2013.01); *B22F 3/1017* (2013.01); *B22F 9/04* (2013.01); *B30B 11/008* (2013.01); *B30B 11/027* (2013.01); *B30B 15/022* (2013.01); *B30B 15/302* (2013.01); *C22C 19/07* (2013.01); *C22C 28/00* (2013.01); *C22C 38/00* (2013.01); *C22C 38/002* (2013.01); *C22C 38/005* (2013.01); *C22C 38/06* (2013.01); *C22C 38/10* (2013.01); *C22C 38/16* (2013.01); *H01F 1/0551* (2013.01); *H01F 1/0557* (2013.01); *H01F 1/0573* (2013.01); *H01F 1/086* (2013.01); *H01F 41/0273* (2013.01); *B22F 2009/044* (2013.01); *B22F 2301/355* (2013.01); *B22F 2302/45* (2013.01); *B22F 2303/01* (2013.01); *B22F 2304/10* (2013.01); *B22F 2998/10* (2013.01); *C22C 2202/02* (2013.01)

(56) References Cited

FOREIGN PATENT DOCUMENTS

| | | | |
|---|---|---|---|
| DE | 10131638 | B | 1/2002 |
| EP | 2244271 | A | 12/2008 |
| JP | 61-34242 | B2 | 8/1986 |
| JP | H07-153612 | | 6/1995 |
| JP | H09-097731 | | 4/1997 |
| JP | 2731337 | B2 | 3/1998 |
| JP | 2000-096104 | A | 4/2000 |
| JP | 2001-323301 | A | 11/2001 |
| JP | 2006-19521 | A | 1/2006 |
| JP | 2006-97090 | A | 4/2006 |
| JP | 2008-294469 | A | 12/2008 |
| JP | 4391980 | B2 | 12/2009 |
| JP | 2010-240956 | A | 10/2010 |
| JP | 2012-60139 | A | 3/2012 |
| JP | 2013-175735 | A | 9/2013 |
| KR | 2011-0116757 | A | 10/2011 |
| WO | 2009/013786 | A | 9/2010 |

OTHER PUBLICATIONS

Office Action dated Oct. 27, 2017, issued in Chinese Patent Application No. 201580000825.6.

Office Action dated Mar. 15, 2018, issued in Korean Patent Application No. 10-2015-7033878.

International Search Report (PCT/ISA/210) and Written Opinion (PCT/ISA/237) dated Sep. 8, 2015 issued in counterpart International patent application No. PCT/JP2015/076676. (6 pages).

* cited by examiner

[Fig. 1]
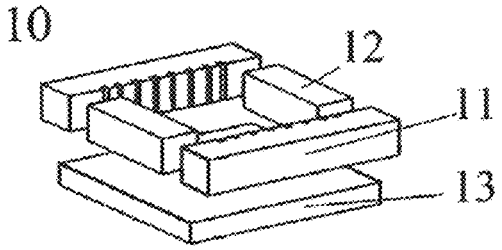
[Fig. 2]
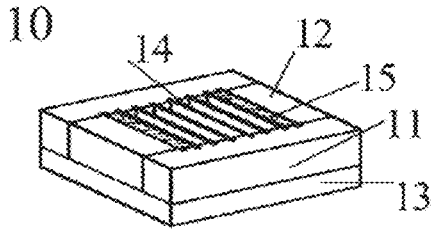
[Fig. 3]
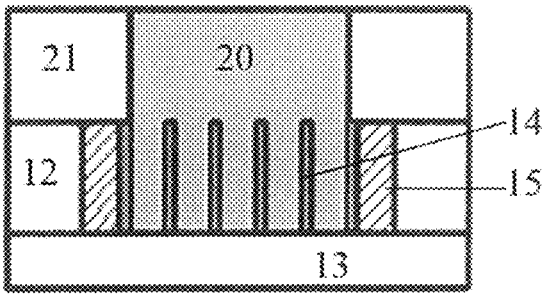
[Fig. 4]
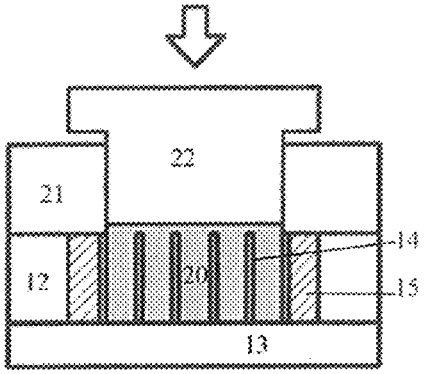

[Fig. 5]
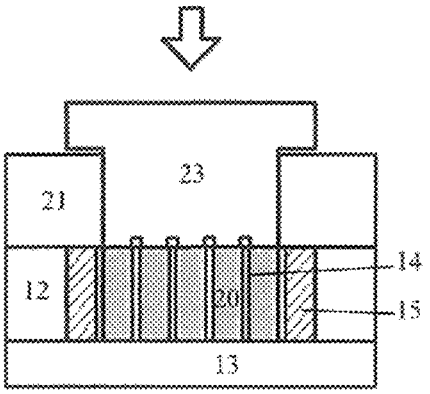
[Fig. 6]
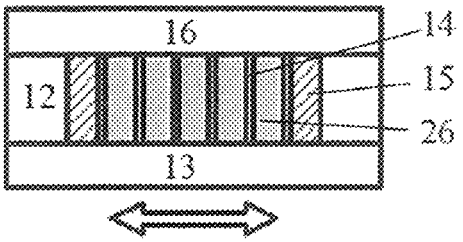
[Fig. 7]
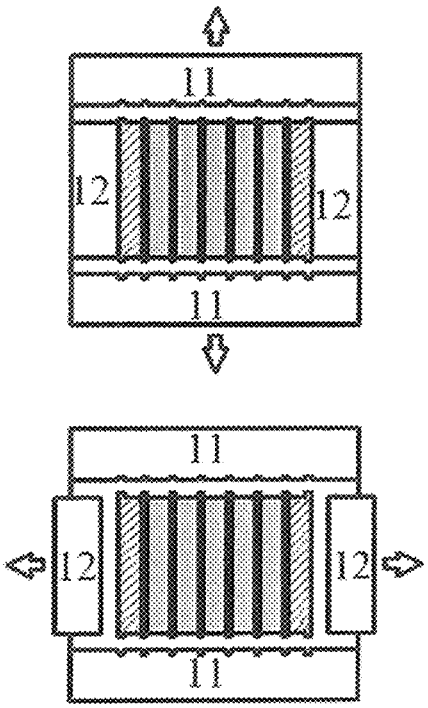

[Fig. 8]
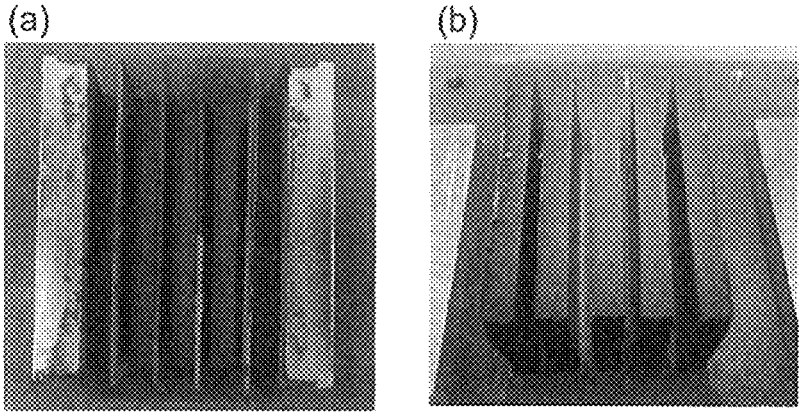
[Fig. 9]
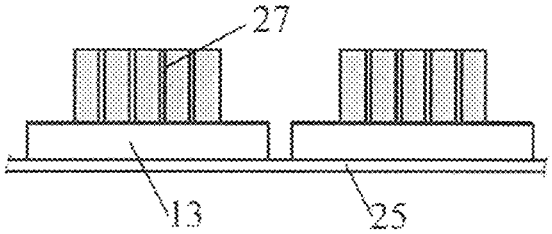
[Fig. 10]
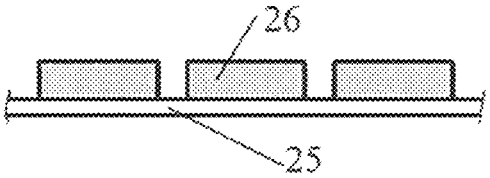
[Fig. 11]
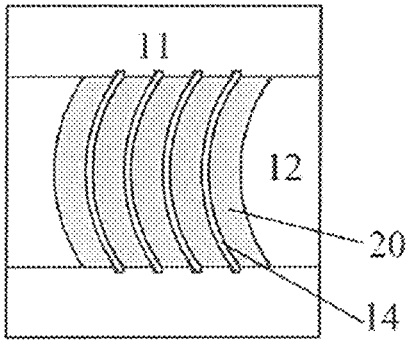

[Fig. 12]
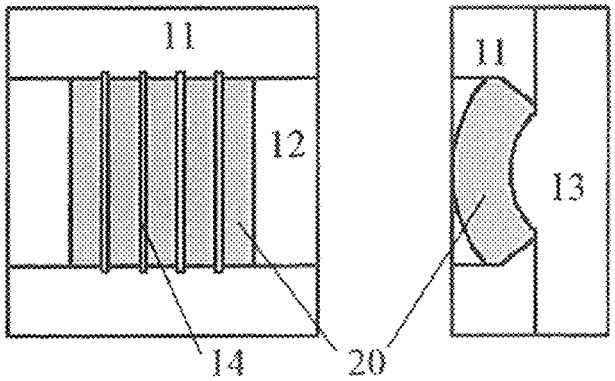
[Fig. 13]
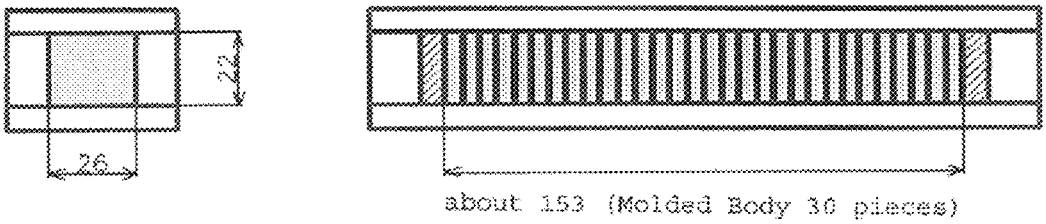

[Fig. 14]
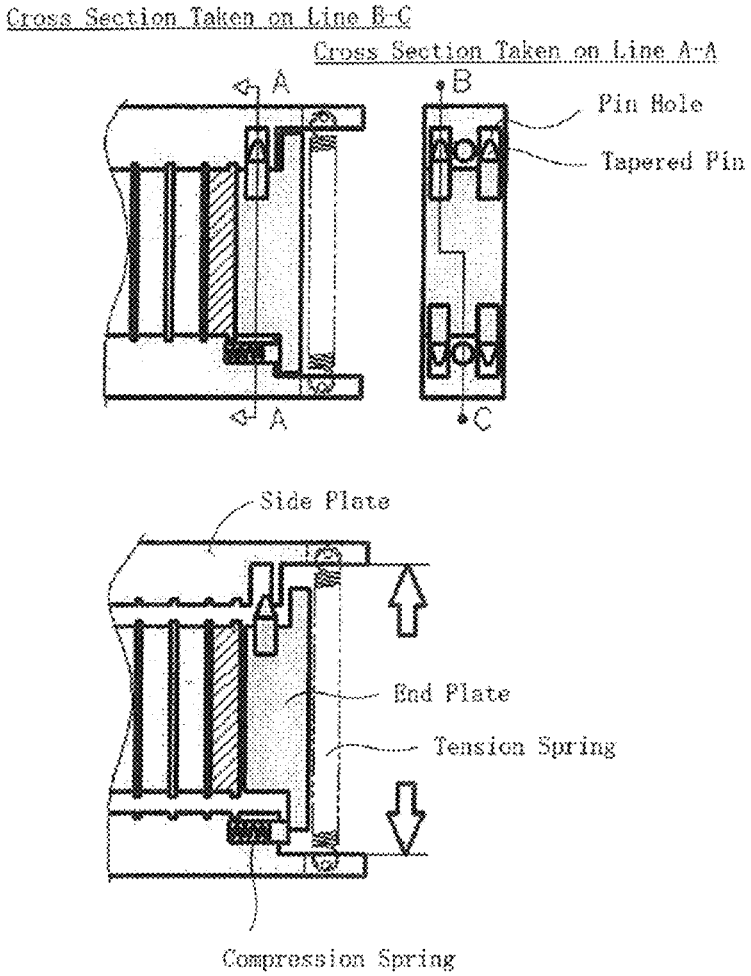
[Fig. 15]
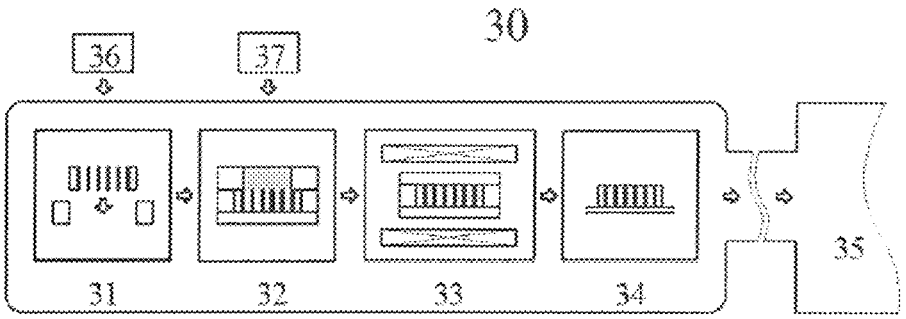

[Fig. 16]
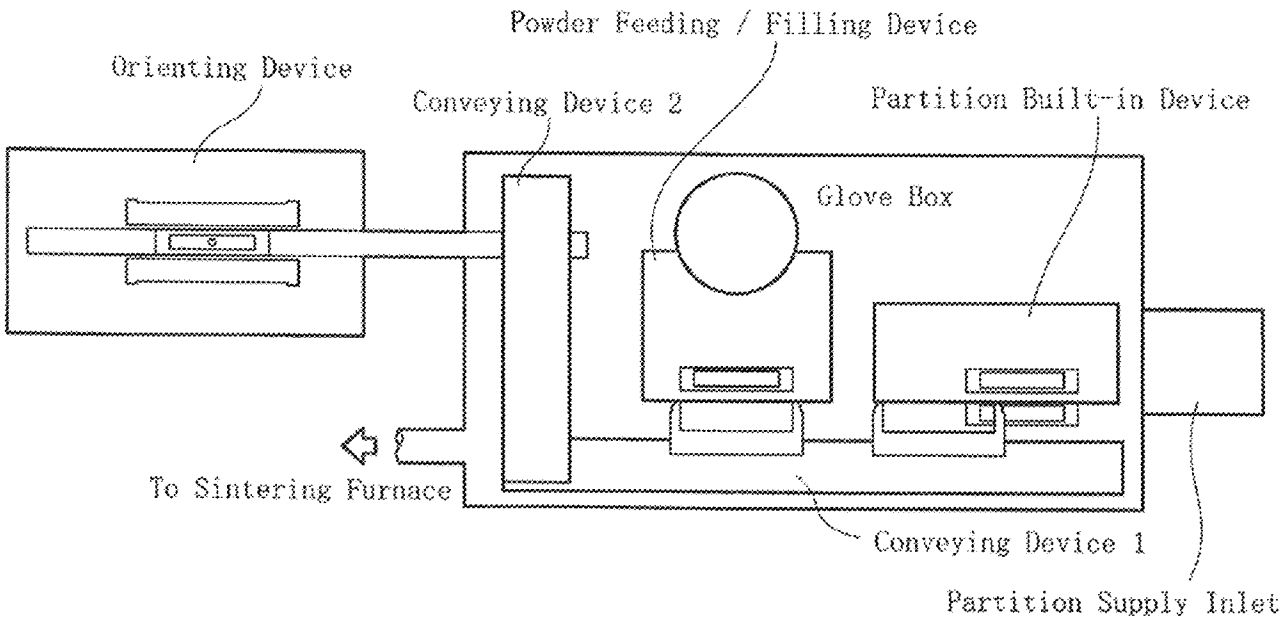

PRODUCTION METHOD OF RARE EARTH SINTERED MAGNET AND PRODUCTION DEVICE USED IN THE PRODUCTION METHOD

TECHNICAL FIELD

The present invention relates to a method for producing a magnetic anisotropic rare earth sintered magnet and a production device of a magnetic anisotropic rare earth sintered magnet.

BACKGROUND ART

Nd—Fe—B-based rare earth sintered magnet was invented by Sagawa being an inventor of the present application et al. in 1982, and its characteristics far outperforms conventional permanent magnets materials and is widely put to practical use (Patent Document 1). Particularly, it has been widely used for a compressor of an air conditioner, a motor or an electric generator of a hybrid car, and a voice coil motor (VCM) of a hard disc, and it helps in downsizing of equipment and saving energy, and contribute to prevention of global warming. Shapes of the rare earth sintered magnets used in these applications are a straight flat plate shape, a curved arc segment plate shape, a sectorial flat plate shape and the like. These plate-shaped rare earth sintered magnet is a thin-walled article in which a thickness in an orientation direction is small compared with a vertical or horizontal length of a plate. In addition, as the rare earth sintered magnet, Sm—Co-based magnet is put to practical use in addition to Nd—Fe—B-based magnet. Hereinafter, both magnets are collectively referred to as a "rare earth sintered magnet". Sometimes the Nd—Fe—B base includes another rare earth element such as Pr or Dy, but in the present specification, these are generically referred to as a Nd—Fe—B base.

A rare earth alloy powder (hereinafter, referred to as a "alloy powder") serving as a material of a rare earth sintered magnet is very chemically active, and is not only rapidly oxidized to be degraded, but also ignites sometimes in the atmosphere, and therefore the alloy powder has to be handled in an inert gas atmosphere not containing oxygen. Thus, a rational production process for producing a rare earth sintered magnet from the alloy powder is desired.

As a method for producing a thin-shaped rare earth sintered magnet, two methods are heretofore known. One method is a metallic mold pressing method in which an alloy powder is filled into a metallic mold and press formed in a magnetic field to prepare an molded powder compact and the molded powder compact is sintered (Non-patent Document 1), and another method is a press-less process in which an alloy powder is filled into a filling container (hereinafter, referred to as a "mold") and oriented by a pulsed magnetic field to obtain an oriented filled-molded-body and the oriented filled-molded-body is sintered remaining housed in the mold (hereinafter, referred to as a "PLP method") (Patent Document 2).

In the metallic mold pressing method, since it is difficult to press form a thin-walled product, a large block-like molded powder compact is prepared first using a large metallic mold, and the molded powder compact is retrieved from the metallic mold and sintered to obtain a block-like sintered body. The large block-like sintered body is sliced with a peripheral edge cutting machine to form a thin-walled plate-like product. A slicing step costs a great deal, and a large amount of chips are generated during the slicing step and this reduces yields of a raw material (a ratio of a product amount actually achieved to a product amount expected from a raw material input). Therefore, the metallic mold pressing method has the disadvantage that a product price is increased.

Technical contents and problems of the metallic mold pressing method are described in detail in paragraphs [0002] to [0042] of Patent Document 3.

In the metallic mold pressing method, a metallic mold is placed between magnetic poles for a static magnetic field, and an alloy powder is charged into the metallic mold (Patent Document 4). After charging the alloy powder, an upper punch is lowered and a lower punch is simultaneously raised to apply a pressure to the alloy powder between the upper and lower punches while applying a magnetic field, and thereby a molded powder compact can be obtained. If the upper and lower punches are raised, the molded powder compact can be retrieved from the metallic mold. The molded powder compact is sintered to obtain a block-like sintered body.

In the PLP method, it is common to dispose partitions in the mold to produce a plurality of products simultaneously. An alloy powder is charged into a plurality of cavities defined by a plurality of partitions, covered with a lid, and the alloy powder is oriented by applying a pulsed magnetic field, and the obtained oriented filled-molded-body housed in the mold is sintered with the mold (Patent Document 2). By this method, a thin-walled plate-like rare earth sintered magnet with less bending can be produced with efficiency. Since this method achieves a high raw material yield and can reduce process costs, it comes to be employed in mass-production factories.

As the mass production technology of the rare earth magnet, the PLP method has the following problems.

(1) Since the mold is used during sintering, a lot of molds are required. The reason for this is that as the mass production technology, it takes several tens of hours to undergo the sintering step, but it takes only about 5 minutes to undergo the powder feeding/filling/orienting steps.

(2) Since the mold has to be made precisely, it takes processing cost. Mold manufacturing cost is expensive.

(3) Since the mold is used for mass production, it is assumed that the mold is used repeatedly. In order to use the mold repeatedly, a material of a container portion or a partition constituting the mold must be selected and a thickness thereof must be adequately large. When a wall thickness is increased, material cost is increased, and an occupied volume of the mold in the process step increases, and the productivity per each device from a powder filling device, a powder magnetic field orienting device to a sintering device is lowered.

(4) Since the mold is exposed to a high sintering temperature, it reacts with an alloy powder more than a little to be depleted whichever material the mold is made of. Therefore, the mold cannot be permanently used, the number of uses is limited, and mold cost is increased.

(5) When the mold is made of a metal, the thicknesses of portions of the mold can be reduced; however, since a metal is easily deformed during sintering at elevated temperatures, there is a limit on repeated use. Therefore, the efforts of decreasing a particle size of the alloy powder and lowering a sintering temperature are made (Patent Document 5); however, the deformation of the metal mold cannot be suppressed. Further, the metal mold easily reacts with the alloy powder, and therefore it is necessary to apply a ceramic powder to the mold every time before filling an alloy powder into the mold (Patent Document 6), and this increases a product price.

(6) When the thickness of the partition is increased in order to make the mold robust, variations in the amount of feeding of the alloy powder into the cavity defined by the partition easily occurs, resulting in the occurrence of variations in product dimensions.

PRIOR ART DOCUMENTS

Patent Documents

Patent Document 1: JP Patent No. 1431617
Patent Document 2: JP-A-2006-019521
Patent Document 3: JP Patent No. 4391980
Patent Document 4: JP Patent No. 2731337
Patent Document 5: JP-A-2012-060139
Patent Document 6: JP-A-2008-294469
Patent Document 7: JP-A-2006-97090

Non-Patent Document

Non-patent Document 1: Yoshio Tawara, and Ken Ohashi, "RARE EARTH PERMANENT MAGNET", Morikita Shuppan Co., Ltd. (1999), pp. 60-63

SUMMARY OF THE INVENTION

Problems to be Solved by the Invention

Various problems of the PLP method described above occur in association with the fact that a mold prepared at expense is carried in a sintering furnace and results from the fact that the mold needs to be used repeatedly. If the mold is not carried in a sintering furnace, the number of the required molds is significantly reduced, depletion of the mold vanishes, and it is not necessary to make a robust mold. Moreover, time and effort for cleaning of dirty or repair of failure of the mold generated during sintering vanish. Most of the various problems described above will be solved if developing a production method in which the mold is not carried in a sintering furnace while making use of merits of the PLP method.

It is an object of the present invention to provide a PLP method in which a mold is not carried in a sintering furnace, and thereby, to provide a method in which production cost of the rare earth sintered magnet can be significantly reduced.

Means for Solving the Problems

A method for producing a magnetic anisotropic rare earth sintered magnet of the present invention comprises a powder feeding step of feeding an alloy powder into a mold having side walls divided into two or more sections; a filling step of filling the alloy powder into the mold to prepare a filled molded-body; an orienting step of orienting the alloy powder in the filled molded-body by applying a magnetic field to the filled molded-body to prepare an oriented filled-molded-body; a retrieving step of detaching the side walls of the mold from the oriented filled-molded-body and retrieving the oriented filled-molded-body from the mold; and a sintering step of sintering the retrieved oriented filled-molded-body, wherein the filling step and the orienting step are performed at different locations.

Further, the present invention is characterized by building one or plural removable partitions in the inside of the mold and partitioning the inside of the mold into a plurality of cavities by partitions in the production method of the magnetic anisotropic rare earth sintered magnet having the above-mentioned characteristics.

Further, the present invention is characterized by providing a partition built-in step prior to the powder feeding step in the production method having the above-mentioned characteristics.

Further, the present invention is characterized in that a powder feeding spacer is placed on the mold and a predetermined amount of an alloy powder is charged into a space defined by the mold and the powder feeding spacer in the powder feeding step in the production method having the above-mentioned characteristics.

Further, the present invention is characterized by disposing the powder feeding spacer capable of feeding the alloy powder to one or plural cavities of the mold in the production method having the above-mentioned characteristics.

Further, the present invention is characterized in that in the filling step in the production method having the above-mentioned characteristics, a push-in punch member for housing all of the predetermined amount of the alloy powder charged into a space defined by the mold and the powder feeding spacer within the mold, is placed above the mold, and in this state, the mold is dropped repeatedly from a certain height, and thereby all of the alloy powder is housed within the mold and a density of the alloy powder is increased.

Further, the present invention is characterized in that the oriented filled-molded-body is retrieved together with the partitions in one united body in the retrieving step in the production method having the above-mentioned characteristics.

Further, the present invention is characterized in that in the production method having the above-mentioned characteristics, the powder feeding step and the filling step of the respective steps are performed at the same location, and the powder feeding step/the filling step, the orienting step, the retrieving step, and the sintering step are respectively performed at different work locations.

Further, the present invention is characterized in that in the production method having the above-mentioned characteristics, the powder feeding step, the filling step, the orienting step and the retrieving step are performed in a single chamber or plural chambers communicated with one another, and inside of the single or plural chamber is filled with an inert gas.

Further, the present invention is characterized in that the partition built-in step is performed prior to the powder feeding step, and the partition built-in step and the powder feeding step are performed in the same chamber in the production method having the above-mentioned characteristics.

Further, the present invention is characterized in that the mold is composed of side walls consisting of two side plates and two end plates, and one bottom plate in the production method having the above-mentioned characteristics.

Further, the present invention is characterized by including a magnetic pole at both internal ends of the mold in the production method having the above-mentioned characteristics.

Further, the present invention is characterized in that the oriented filled-molded-body is retrieved together with the partitions and the magnetic poles in the retrieving step in the production method having the above-mentioned characteristics.

Further, the present invention is characterized in that the oriented filled-molded-body is sintered together with the partitions in the sintering step in the production method having the above-mentioned characteristics.

Further, the present invention is characterized in that the oriented filled-molded-body is sintered together with the magnetic poles in the sintering step in the production method having the above-mentioned characteristics.

Further, the present invention is characterized in that the oriented filled-molded-bodies are taken off from the partitions/the magnetic poles and discretely sintered in the sintering step in the production method having the above-mentioned characteristics.

Further, the present invention is characterized in that in the retrieving step in the production method having the above-mentioned characteristics, the mold from which the oriented filled-molded-body has been retrieved is conveyed to the partition built-in step or the powder feeding step and reused.

Further, the present invention is characterized in that a magnetic field applied in the orienting step in the production method having the above-mentioned characteristics is a pulsed magnetic field.

A production device of a magnetic anisotropic rare earth sintered magnet of the present invention comprises, in a single chamber or a plurality of chambers communicated with one another which is filled with an inert gas, a powder feeding device for feeding an alloy powder into a mold having side walls divided into two or more sections; a filling device for filling the alloy powder into the mold to prepare a filled molded-body; an orienting device for orienting the alloy powder in the filled molded-body by applying a magnetic field to the filled molded-body to prepare an oriented filled-molded-body; a retrieving movable member for detaching the side walls of the mold from the oriented filled-molded-body and retrieving the oriented filled-molded-body from the mold; and a conveying device for conveying the retrieved oriented filled-molded-body to a sintering furnace.

Further, the present invention is characterized in that in the production device having the above-mentioned characteristics, a magnetic field applied to the filled molded-body is a pulsed magnetic field.

Further, the present invention is characterized by comprising a conveying device for returning side walls of the mold from which the oriented filled-molded-body has been retrieved to the powder feeding device in the production device having the above-mentioned characteristics.

Further, the present invention is characterized by further comprising a partition built-in device for building partitions in the side walls of the mold and a conveying device for returning side walls of the mold from which the oriented filled-molded-body has been retrieved back to the partition built-in device in the production device having the above-mentioned characteristics.

Further, the present invention is characterized that the production device having the above-mentioned characteristics further comprises a sintering furnace, wherein the sintering furnace is connected to the conveying device.

The production device of a magnetic anisotropic rare earth sintered magnet of the present invention has a structure in which one chamber or plural chambers communicated with one another, the chambers including the powder feeding device, the filling device, the orienting device and the conveying device therein and being filled with an inert gas, are connected to a chamber including, therein, the sintering furnace for sintering the retrieved oriented filled-molded-body through an airtight passage, and the production device can perform all production steps.

Since the inside of the sintering furnace is usually at high temperature under vacuum, it is difficult to dispose the furnace on a side of a chamber in which another device is disposed. However, when the chamber including another device disposed therein is communicated with the chamber including the sintering furnace disposed therein through an airtight passage, the need for retrieving a highly reactive alloy powder from a container in the middle of a production process is eliminated, and therefore it is practically convenient.

In the production method of the magnetic anisotropic rare earth sintered magnet of the present invention, assembling of the mold having side walls divided into two or more sections (including built-in of partitions if the partitions are present) may be performed in an inert gas atmosphere as with other steps. When the production method of the magnetic anisotropic rare earth sintered magnet of the present invention further includes, therein, a mold assembling device and/or a partition built-in device, it can perform assembling the mold as well as building partitions in the mold in this order in the same chamber. In addition, when the side walls of the mold are not disassembled in the step of retrieving oriented filled-molded-body from the mold (the case in which the side walls are biased by a spring and automatically returned again to an original configuration), since a mold assembling device is unnecessary, the production device may have only a device for building partitions in the mold.

If the mold disassembled in the retrieving step can be reassembled and reused within the same atmosphere, not only time and effort for importing/exporting the mold can be saved but also reuse of the mold becomes easy, and therefore the number of molds to be prepared can be reduced and the rationalization of production steps becomes possible.

In the production method of the present invention, the powder feeding step, the filling step, the orienting step, and the retrieving step are performed in an inert gas atmosphere since the alloy powder is highly reactive and is easily oxidized. Sometimes the alloy powder ignites in the air. The term inert gas atmosphere refers to, for example, a nitrogen gas atmosphere or an argon gas atmosphere, and refers to an atmosphere in which oxygen or water is reduced as far as possible. In addition, in addition, the sintering step is usually performed in a vacuum or a reduced pressure. Further, the powder feeding step, the filling step, the orienting step, and the retrieving step may be repeated to produce 1000 to 2000 oriented filled-molded-bodies (stacked block), and then the sintering step may be performed.

(Mold)

The mold used in the production method of the present invention may be one assembled in each case using the side walls divided into two or more sections and a bottom plate (assembled mold), or may be one having a structure in which side walls positioned opposite to each other is biased outwardly by a spring so as to be movable outwardly in retrieving the oriented filled-molded-body (side wall movable mold). In the present invention, it is common to employ a structure in which in order to prevent the bottom plate from being detached from the side wall in dropping the mold in the subsequent filling step, the bottom plate and the spacer, and side wall are fixed by an air cylinder, and the whole including the air cylinder moves up and down by the drive of a cam attached so as to be in contact with a lower face of the bottom plate, and thereby a density of the powder on an upper face of the bottom plate is increased. A lid plate can be attached to the mold for covering an upper surface of the mold after completion of the filling step.

The mold can include partitions in the inside of the mold. When the inside of the mold is partitioned into plural cavities by one or plural partitions, the number of sintered magnets equal to the number of cavities can be produced at once with one mold. It is preferred that the plurality of partitions are all placed in parallel to one another and cavities are lined in an orientation direction since this facilitates the orienting step. When the partitions are disposed, the number of cavities can be 2 to 100; however, it is preferably about 5 to 70. When the number of cavities is increased and the cavities form a long line, there is the effect of suppressing disturbance of the orientation and productivity can be enhanced.

One sintered magnet is produced in each of cavities within the mold. It is different from the way in which a large massive article is produced and sintered, and a sintered article is cut into a plurality of slices in the metallic mold pressing method. In the present invention, the slicing step for producing a thin-shaped magnet is not required.

In the retrieving step prior to the sintering step, if a lid plate is removed at first, and then the side walls are dissected out or moved so as to be separated off outwardly, the oriented filled-molded-body housed in the mold can be retrieved together with the partitions.

In the conventional PLP method in which a sintering mold is repeatedly used, a thickness of the partition cannot be substantially reduced in order to secure mechanical strength. However, in the method of the present invention in which the mold is removed before sintering, the thickness of the partition can be reduced. The thickness is 0.5 mm or less, and preferably 0.3 mm or less. Even if the thickness is small like this, the mold can adequately stand the stress applied to the partition in filling the alloy powder or in orienting the alloy powder. From the viewpoint of a limit of mechanical strength of the partition, the limit of the thickness of the partition is 0.1 mm.

A material of the partition is selected from among iron alloys such as iron, silicon steel sheet, stainless steel, and permalloy; high melting point metal such as molybdenum and tungsten; carbon and various ceramics. The partition of an iron alloy is preferably subjected chemical conversion treatment such as phosphate treatment, chromate treatment, black oxide coating and passivation, applying a silicon resin and heating treatment, and applying a graphite powder to the surface coated with a resin and baking by heating in order to avoid welding with an alloy powder in sintering step. Coating is not required of the partition made of carbon. The partition made of an iron alloy can be disposal since it can be manufactured at low cost by precision punching method.

The magnetic pole may be placed in parallel to the partition at both ends in the mold. The magnetic pole has the effect of uniformalizing a magnetic field applied to the alloy powder and aligns its orientation direction. When the magnetic pole is made of a material, such as iron or silicon, which is not deformed by sintering, the mold does not need to be removed in sintering. The magnetic pole aligns the orientation direction of magnetic particles in the sintered body and is useful for improving quality of the sintered body and preferred. However, when the disturbance of the orientation can be neglected even though the magnetic pole is not present, the magnetic pole is not required.

A material of the magnetic pole is preferably iron alloy such as pure iron having a property of a electromagnetic material, silicon-steel, and magnetic stainless. The magnetic pole is prepared by machining these metals, or laminating a thin plate, a sintered body of a powder, and filling a powder into a container. The magnetic pole has a shape of a rectangular parallelepiped and quadrangular pyramid with a flat tip. A thickness of the magnetic pole is a length of a cavity in a direction perpendicular to a partition as a standard.

(Mold Assembling Step/Partition Built-in Step)

A mold having the side walls divided into two or more sections is prepared, and partitions, and magnetic poles as required are built in the inside of the mold. In addition, the bottom plate may be built in the mold in the powder feeding step. However, the mold used in the production method of the present invention is not limited to a mold having a structure in which the side walls and the bottom plate can be disassembled to each part as shown in FIG. 1, and may be a mold having a structure in which side walls divided into two or more sections are integrated in a state of being movable outwardly (since the side walls are not integrated with the bottom plate, in the powder feeding step, the side walls are placed on a bottom plate separately prepared), and in this case, the side walls may be returned again to the original position after retrieving the post-orienting-step filled molded-body from the mold, and therefore the above-mentioned mold assembling step is unnecessary. Examples of a configuration in which the side walls of the mold are integrated include a structure, shown in FIG. 14, in which both ends of the mold are connected to each other. In this configuration, the side walls of the mold are connected by a spring, and when a clasp is inserted into inside of the mold and the space between the side walls is opened up with the clasp, an article sandwiched between side walls can be retrieved.

(Powder Feeding Step)

Since the alloy powder is handled from the powder feeding step downward, powder feeding has to be performed in an inert gas atmosphere.

The powder feeding spacer is placed on the mold, and a predetermined amount of an alloy powder is charged into this space. The powder feeding spacer is required since a bulk density of an alloy powder during powder feeding is lower and a volume of the alloy powder is larger than those at the time of completing filling.

The predetermined amount (weight) of the alloy powder can be calculated from a volume of the cavity of the mold and a packing density of the post-filling alloy powder. When the packing density of the post-filling alloy powder is too high, magnetic orientation cannot be carried out, and when the packing density is too low, a density of a sintered body after sintering cannot be high. The optimum packing density (in general, about less than 45 to 55% of a theoretical density) is experimentally determined powder by powder. The height of the powder feeding spacer can be calculated in advance since a volume of the predetermined amount of the alloy powder at the time of being charged is determined from the predetermined amount and a density of a raw material alloy powder.

Herein, the packing density refers to a bulk density at the time when filling is completed.

(Filling Step)

In the alloy powder charged into a cavity defined by the mold and the spacer, after the push-in punch member, as shown in FIG. 4, is placed above the mold, and the mold in this state is dropped repeatedly from a certain height to provide impact for the alloy powder, and thereby a density of the alloy powder is gradually increased to reduce a volume of the powder. In order to uniformly increase the density of the alloy powder, a dropping distance of the mold is preferably about 3 to 15 cm, and particularly preferably 5 to 10 cm. The number of droppings of the mold is commonly about 5 to 20 times, and preferably around 10 times (about 8 to 12 times). By dropping the mold repeatedly with the weight of the punch member applied to an upper portion of the powder, a difference in density between the upper portion and the lower portion of the alloy powder in the mold cavity hardly occurs and uniform filling can be achieved. When the density reaches a predetermined value, that is, all of the alloy powder is housed in the mold, filing is completed. At this time, the packing density of the alloy powder becomes a predetermined set value. The alloy powder in this state has some mechanical strength and can maintain its shape. This is referred to as a filled molded-body.

When the thickness of the partition is reduced, the alloy powder can be easily uniformly filled into each cavity defined by the partition. When the thickness of the partition is large, a powder feeding spacer needs to be disposed for each of the cavities to fill the powder in order to avoid accumulation of the powder on an upper end of the partition. Since a mold having many cavities includes many powder feeding spacers, variations in the amount of powder feeding leads to variations in the filled amount. When the thickness of the partition is small, since the amount of the powder accumulating on the top end of the partition is small, one powder feeding spacer is enough for all cavities in a mold. Moreover, when a top cross section of the partition is formed into an acute shape, it is possible to more prevent the powder from accumulating on the partition.

The alloy powder can be uniformly filled into all cavities by feeding an alloy powder to one space surrounded by spacers. It is naturally more difficult that the powder is filled into many small cavities separately to decrease the cavity-to-cavity variations of charged amount compared with the case in which the powder is uniformly filled into one large space. When the number of the spaces is one, it can be easily realized to weigh the weight of the powder, feed and minimize the variation of a weight of powder feeding since weighing is only one time per one mold and the weight of weighing is large. A principal surface (surface with a larger area) of the filled molded-body of the alloy powder to be filled is parallel to the partition, moving distance on the top surface of the powder from the start of filling to the end of filling is large, and some variation of a density is mitigated during filling, and therefore the effect of uniformalization is large. Even when the thickness of the partition is small, since the difference in packing density between adjacent cavities is small, the partition is not curved by a pressure difference between cavities.

If the cavity-to-cavity variations of charged amount in the mold can be decreased, the dimensional variation of the sintered body after sintering can be decreased and therefore machining after sintering can be minimized. The reason why the alloy powder can be filled into many cavities simultaneously like this, and the cavity-to-cavity variations of filling can be decreased is that one powder feeding spacer and a mold including an extremely thin partitions can be used.

(Orienting Step)

The mold holding the filled molded-body is place on a flat plate in the orienting device and a lid plate is put on the mold. In addition, the bottom plate of the mold used in the powder feeding/filling steps does not need to be brought in the orienting device. Since the filled molded-body does not fall off the mold side wall even though the bottom plate is not present after the filling step, only the side wall of the mold and the filled molded-body within the side wall may be carried in the orienting device and place on another bottom plate, and then the orienting step may be performed. In the orienting step, the alloy powder is oriented by applying a pulsed magnetic field to the filled molded-body to prepare an oriented filled-molded-body. The oriented filled-molded-body has the ability to maintain a shape and is not deformed/collapsed by a small mechanical stimulus.

The sintered magnet is usually thin-shaped and the magnetic field is applied in a direction perpendicular to a thin plate of the sintered magnet. In the alloy powder molded-body, a molded body formed by partitioning the alloy powder molded-body by each partition is thin-shaped, and the powder is oriented by applying a pulsed magnetic field in a direction perpendicular to a principal surface of the thin-shaped molded body. In the configuration in the present invention, since in the thin-shaped molded body, many molded bodies are set in line and oriented by a magnetic field simultaneously, a length of magnetization direction to a cross-section area perpendicular to a magnetization direction can be increased, and consequently bending of the orientation can be decreased and hence the deformation resulting from the orientation of the sintered body can be decreased.

The pulsed magnetic field using an air core coil can exert a stronger magnetic field than the static magnetic field by an electric magnet. When a strong magnetic field is applied, magnetic characteristics after sintering is improved since crystal axes of particles constituting the powder can be more aligned in one direction.

A pulsed magnetic field used in the present invention will be described. When the magnet powder is oriented by the metallic mold pressing method, an orienting magnetic field has to be applied throughout a period of time during which the punch moves and compresses the powder. The period of time is usually 20 seconds or more, and 10 seconds at a minimum. Intensity of the orienting magnetic field continuing to be applied during the hours is about 1.5 tesla, and is limited to 2 tesla at a maximum. The reason for this is that the intensity of a DC field which can be applied to a space including a metallic mold housing the filled powder is limited to 2 tesla of a realizable upper limit. In the present invention, a magnetic field of 2 tesla is insufficient for orienting a magnet alloy powder filled into the mold at a high density. The reason why the pulsed magnetic field is used in the present invention is that although a time of applying a magnetic field is shortened, a high magnetic field of 2 tesla or more is applied. In the present invention, a desired range of the intensity of the applied magnetic field is 3 tesla or more, and 3.5 tesla is required in order to achieve such high orientation that a ratio of remanent magnetization to saturated magnetization is 93% or more, and 4 tesla or more is required to achieve the orientation of 95% or more. In the present invention, usually, charges stored in a capacitor bank are discharged in a short time to pass a large electric current through a normal conduction air core coil, and thereby a high magnetic field is generated. A width of one pulsed magnetic field is usually 1 ms to 1 second. A wave shape of the pulsed current may be a pulsed wave shape of a direct current (one direction) or may be an alternating decaying wave shape. The pulsed magnetic field of the wave shape of DC pulse may be combined with the pulsed magnetic field of the wave shape of alternating pulse, or a high magnetic field may be generated by passing a large current through a high-temperature superconducting air core coil recently developed. In the superconductivity, since change in current in a short time is difficult, magnetic field application of 1 second or more may be used. However, the time of applying a magnetic field is preferably 10 seconds or less in consideration of the efficiency of the step.

(Retrieving Step)

In the retrieving step, the side walls constituting the mold are detached from the oriented filled-molded-body and the oriented filled-molded-body is retrieved from the mold. When the partitions are present, the oriented filled-molded-body is retrieved together with the partitions. When the magnetic pole is used, it may be retrieved simultaneously. Specifically, the side walls of the mold are removed and the oriented filled-molded-body on the bottom plate is moved to a pedestal for sintering (hereinafter, referred to simply as a pedestal). In addition, the pedestal is made of a material standing a sintering temperature. When the bottom plate of the mold is made of a material standing a sintering temperature, the bottom plate of the mold can be used as the bottom plate of the mold.

Further, although the retrieving step is performed at a location different from that of the orienting step, the bottom plate used in the orienting step does not need to be brought in the location at which the retrieving step is performed, and the retrieving step may be performed placing side walls of the mold and the oriented filled-molded-bodies therein on another bottom plate prepared at a retrieving location.

The oriented filled-molded-body or a stacked block of the oriented filled-molded-body and the partitions is placed on pedestal and conveyed to the sintering furnace. When the packing density of the alloy powder is as high as a certain value or more and attention is given to avoid inclining or heavily vibrating the pedestal, the oriented filled-molded-body keeps a shape as is filled.

The packing density for avoiding the collapse of a shape of the oriented filled-molded-body of the alloy powder varies largely depending on an average particle size of the powder, a shape of the particle, the presence or absence and the additive amount of lubricant addition or the like. The packing density of the alloy powder required for maintaining a shape of a standard oriented filled-molded-body for a rare earth sintered magnet must be at least about 35% or more of a theoretical density of the alloy. In the powder having a lubricant added, a value of this density is about 40% or more. As described above, when the alloy powder is filled at a packing density of a certain value or higher into a sintering mold, particles of the alloy powder are entangled with one another to maintain a shape. The maintaining of a shape of the alloy powder is enhanced by applying a magnetic field to the alloy powder to orient the powder in addition to increasing the packing density of the alloy powder. The reason for this is that interaction between particles increases by magnetization of the alloy powder.

(Sintering Step)

The oriented filled-molded-body or a stacked block of the oriented filled-molded-body and the partitions is placed on pedestal, conveyed to the sintering furnace, and sintered. Since the mold is removed, volume efficiency of a product in the sintering furnace is higher and the productivity is higher than the conventional PLP method in which the mold is not removed. Further, since by the amount of removing the mold, a heat capacity is small, a temperature distribution is uniformalized, and since an exhausting property of a gas generated from the alloy powder is good, deformation resulting from sintering is small and variations of the characteristics are small.

The oriented filled-molded-body or the stacked block is sintered at elevated temperatures to form a sintered magnet. The shape of the oriented filled-molded-body is maintained without the mold, and sintering proceeds with temperature increase. The sintering temperature and the sintering time are appropriately set based on composition or particle size of the alloy powder. In the case of Nd—Fe—B-based rare earth sintered magnet, a typical sintering temperature is 900 to 1100° C., and a typical sintering time is about 10 to 40 hours including a temperature rising time.

After completion of sintering, the molded body is appropriately cooled and retrieved from the production device to obtain a sintered body.

(Other Steps)

The production device for producing a magnetic anisotropic rare earth sintered magnet of the present invention preferably includes a conveying device for conveying an alloy powder held in the mold or retrieved mold members between the steps. The reason for this is that in the present invention, the powder feeding step and the filling step can be usually performed at the same location, other steps are respectively performed at other locations. As described above, the bottom plate of the mold does not need to be conveyed, and another bottom plate may be used at a different location.

When the mold from which the oriented filled-molded-body has been retrieved in the retrieving step, is immediately conveyed to the partition built-in step or the powder feeding step, the number of required molds is significantly reduced as a whole steps. This becomes possible since the mold is not restricted for a long time in the sintering process.

(Overall Characteristics)

The production method and the production device for producing a magnetic anisotropic rare earth sintered magnet of the present invention is characterized in that the mold undergoes the powder feeding step, the filling step and the orienting step, and the oriented filled-molded-body is retrieved from the mold in the retrieving step, and thereby one use of the mold is completed, and thereafter the mold is used repeatedly. With respect to the bottom plate on which the mold side-walls in the present invention is placed, different plates may be used for each of the powder feeding step, the filling step, the orienting step and the retrieving step.

In the metallic mold pressing method, an alloy powder is put in a metallic mold and a large pressure of several hundred kg/cm$^2$ or more is applied to the alloy powder from above and underneath to prepare a high-density molded powder compact with a bulk density of about 55% or higher (Patent Document 3). While such a large pressure is applied in order to facilitate handling of the molded powder compact, it is difficult to orient the powder by applying the magnetic field after the density reaches about 55%, and therefore the powder is oriented in the static magnetic field since before pressuring to the midst of pressuring. Side walls of the mold subjected to such a large pressure are generally made in one united body and robustly.

On the other hand, in the method of the present invention, the alloy powder is pressed at a pressure of about 10 to 20 kg/cm$^2$ to prepare a filled molded-body having a bulk density of about 45%. Since the alloy powder is pressed by only this level of pressure, a mold whose side wall is dividable can be used.

Examples of an exceptional method in the metallic mold pressing method include a method described in Patent Document 7. In the method, when the metallic mold is closed and a pressure is applied to an alloy powder to increase the density of the powder after feeding the alloy powder to a divided metallic mold, a static magnetic field is applied to the powder to align the orientation of the powder particles. In this method, since it is necessary to always apply the magnetic field during applying a pressure, the static magnetic field is applied. Further, since the metallic mold is fixed to one location, filling of a powder and orientation of the powder by application of a magnetic field are performed at the same location. Disadvantages of the method described in Patent Document 7, view from the present invention, is that since a press machine is used, the device becomes large and it is difficult to lower an oxygen level of the entire device contrasted with the present invention, and that the cavity cannot be divided into many sections by partitions to increase the productivity of preparation of the oriented molded-body contrasted with the present invention.

The metallic mold pressing method is different from the method of the present invention in that the step of mold assembling and the step of retrieving from a divided mold are not present and the powder is filled and pressed in the static magnetic field. In the metallic mold pressing method, a large massive sintered body is obtained and this is cut into sliced plate-like product, and this way is also different from the method of the present invention in that each single plate-like product can be produced from the beginning.

Further, in the metallic mold pressing method, the powder feeding step, the filling step and the orienting step are performed at the same location, and particularly the filling step and the orienting step are performed simultaneously.

The present method and the PLP method are different from each other in that in the present method, the alloy powder is retrieved and sintered, and on the other hand in the PLP method, the alloy powder is sintered with the mold. Both method are the same in that each plate-shaped article can be produced from beginning. In the present method, since the mold is not carried in the sintering step, the number of the required molds is small, a life of the mold is long, resulting in less expense in time and effort for maintenance.

In the present invention, since the mold is not exposed to a sintering temperature, its strength may be low and thicknesses of the respective portions can be decreased. This effect has been described in paragraphs [0023], [0029] and [0030]. In addition, the metallic mold pressing method includes a transverse-field pressing method and a vertical-field pressing method, and in the vertical-field pressing method, a molded body of a thin-shaped magnet can be molded. However, in the vertical-field pressing method, since a highly oriented molded body cannot be prepared, it becomes less used. The metallic mold pressing method described above has been all described with the transverse-field pressing method.

The rare earth sintered magnet includes Nd—Fe—B sintered magnet and Sm—Co-based sintered magnet. The descriptions which have been described are applicable to both magnets. In the case of the Sm—Co-based sintered magnet, a density of the Sm—Co alloy powder to be filled into the mold is set to 35 to 55% of a true density, and preferably set to 50% or less. If after filling, to this density, and orienting the alloy powder by a magnetic field, the mold is removed and the powder is sintered, Sm—Co-based sintered magnet can be prepared as with the Nd—Fe—B sintered magnet.

A sintering temperature of an alloy powder for a Sm—Co-based sintered magnet is as high as 1200° C. Therefore, in the conventional press-less method (PLP method) in which the same mold is used repeatedly and sintered, whichever material the mold is made of, damage of the mold is too heavy, and it is difficult to apply the mold as mass-production technology. In the PLP method of mold-retrieving type of the present invention, it presents no problem that a sintering temperature is high. The PLP method of mold-retrieving type of the present invention is applicable to a Nd—Fe—B sintered magnet as well as a Sm—Co sintered magnet as mass-production technology.

Effect of the Invention

When the assembled mold is used in the production of the rare earth sintered magnet to avoid carrying the mold in the sintering step, the mold members can be quickly returned from the retrieving step to the powder feeding step (or mold assembling step) and the number of the required molds is significantly reduced as the whole steps, and thereby mold cost can be significantly reduced. The reason for this is that as the mass production technology, it takes tens of time to undergo the sintering step, but it takes only about 5 minutes to undergo the powder feeding/filling/orienting steps.

When the assembled mold is used in the production of the rare earth sintered magnet to avoid carrying the mold in the sintering step, mechanical strength of standing high-temperatures in sintering is not required of the mold. As a result of this, thicknesses of parts constituting the mold can be reduced and production unit prices can be reduced. Since the assembled mold is not exposed to a high temperature, it has a low risk of failures or deformation to extend the life of the mold, and the cost for maintenance of the mold after using the mold can be saved. As a result of this, production cost of the rare earth sintered magnet can be remarkably reduced in comparison with the conventional methods.

By this method, many plate-like products such as a rectangle-shaped flat plate product, a deformed flat plate product, and a curved segment-shaped flat plate product can be simultaneously produced with efficiency.

By sintering only a stacked block of the alloy powder and the partitions, the production number of sintered bodies per unit volume of the sintering furnace can be outstandingly increased, and production efficiency is increased. Further, an exhausting property of a gas emitted from the oriented filled-molded-body during sintering is improved and a temperature profile of the sintering furnace is also improved, and therefore magnetic characteristics of the sintered body are improved.

When a mold including partitions is used, a plurality of sintered magnets can be simultaneously produced by one mold without undergoing the slicing step.

When the number of cavities of the mold is increased, many sintered bodies can be produced by one mold. When the number of cavities is increased, since an orientation length in the orienting step (a length in an orientation direction) is lengthened and a ratio of a length to a hollow sectional area of an orienting coil (a cross-section area in a plane perpendicular to a orientation direction) is also increased, bending of magnetic field lines at both ends of a stacked block during orientation can be minimized, and therefore bending of the orientation of the oriented filled-molded-body can be reduced.

Since the thickness of the partition can be reduced, the alloy powder for a rare earth sintered magnet can be easily uniformly filled into plural cavities of the mold.

When a packing density of the alloy powder filled into the mold is increased to a certain value or higher, the shape of the oriented filled-molded-body is not lost during handling before and after sintering or during sintering contrary to conventional technical common sense.

The present invention is applicable to both of the Nd—Fe—B sintered magnet and the Sm—Co-based sintered magnet.

BRIEF DESCRIPTION OF THE DRAWINGS

FIG. 1 is a perspective view showing an assembling process of an example of a mold whose side wall is divided into four sections.

FIG. 2 is a perspective view at the time of inserting magnetic poles and partitions into the mold whose side wall is divided into four sections.

FIG. 3 is a sectional view of the mold immediately after charging an alloy powder in the powder feeding step.

FIG. 4 is a sectional view of a mold at the time of pressing an alloy powder with a flat punch in the filling step.

FIG. 5 is a sectional view of a mold at the time of pressing an alloy powder with a punch with grooves in the filling step.

FIG. 6 is a sectional view of a mold placed in a magnetic field in the orienting step.

FIG. 7 is a view showing a procedure of retrieving an oriented filled-molded-body from the mold in the retrieving step.

FIG. 8 is a photograph showing a state of a post-sintering sintered body on a pedestal in the sintering step.

FIG. 9 is a photograph showing a state of a stacked block placed on a pedestal with a bottom plate in Example 3.

FIG. 10 is a photograph showing a state of a filled molded-body placed on a pedestal in Example 4.

FIG. 11 is a view showing a state at the time of filling a powder in a mold for an arc segment plate-like sintered magnet in Example 5.

FIG. 12 is a view showing a state at the time of filling a powder in a mold for a sectorial flat plate-like sintered magnet in Example 6.

FIG. 13 is a view showing an assembled mold having 30 cavities in Example 7.

FIG. 14 is a view showing a cross-section structure in a connecting portion of the mold of FIG. 13.

FIG. 15 is a view showing an example of a production device of a rare earth sintered magnet.

FIG. 16 is a view showing an example of a production device of a rare earth sintered magnet of the present invention different in configuration from the device of FIG. 15.

MODE FOR CARRYING OUT THE INVENTION

Examples of the present invention will be described below, but the present invention is not limited to these examples. Examples of the rare earth sintered magnet include a Nd—Fe—B sintered magnet and a Sm—Co-based sintered magnet. In the following examples, the result of the Nd—Fe—B sintered magnet is technically applicable to the Sm—Co-based sintered magnet.

(Preparation of Alloy Powder)

Hydrogen disintegration was performed by allowing a strip cast alloy whose composition (weight %) is 23.5% of Nd, 5.5% of Pr, 2.5% of Dy, 0.89% of Co, 0.99% of B, 0.1% of Cu, 0.25% of Al, and rest of Fe to occlude hydrogen, and thereby an alloy crude powder for a NdFeB sintered magnet was obtained. The crude powder was milled by a jet mill using a nitrogen gas to prepare an alloy powder for a NdFeB sintered magnet. A particle size of the powder was measured by laser diffraction-scattering method, and consequently an average particle diameter $D_{50}$ was 4.2 μm. To the powder, zinc stearate was added in an amount of 0.1 wt %, and the resulting mixture was stirred and mixed by a mixer. A sintered magnet was prepared using this alloy powder in each of the following examples.

EXAMPLES

Example 1

Assembling of Mold Whose Side Wall is Divided into Four Sections

The side wall of the mold prototyped was divided into four sections, and a perspective view of the mold is shown in FIG. 1. The mold is composed of side walls consisting of a pair of side plates 11 and a pair of end plates 12, and a bottom plate 13. Grooves for inserting the partitions 14 and the magnetic poles 15 are provided in the side plate 11. This mold whose side wall is divided into four sections can be exactly assembled using screws and positioning pins not shown. As the mold of the present example, a mold made of non-magnetic stainless steel (SUS 304) and a mold made of carbon were prototyped. Both molds functioned well.

In addition, the side wall may be divided into two sections, and one side plate and one end plate may be integrated into one; however, the case of dividing into four sections was easier to use.

6 partitions with a thickness of 0.5 mm made of carbon and 2 poles with a thickness of 5.9 mm made of permalloy were inserted into grooved of the side plates 11 to dispose 5 cavities in the assembled mold. A perspective view of this is shown in FIG. 2. A depth of each cavity was 20.0 mm, A length of a side in the longitudinal direction of a cavity opening was 40.0 mm, and a length of a side in the shorter direction (a direction perpendicular to a partition) of the cavity opening was 4.6 mm. The magnetic pole was disposed so that the magnetic field is exactly perpendicular to the partition in the orienting step and particularly so that bending of the magnetic field at the cavities of both ends is prevented. In addition, the partition is also disposed on the surface of the magnetic pole so that the magnetic pole is not brought into contact with the alloy powder to cause welding during sintering.

(Powder Feeding Step)

The powder feeding spacer 21 was put on the upper portion of the mold. Since a density at the feeding of the alloy powder 20 of the present example is 1.8 kg/cm$^3$ and the packing density at the completion of filling is 3.6 g/cm$^3$, a height of the powder feeding spacer 21 to be used is determined by calculation. Since the required amount of the alloy powder can be calculated to be 66.2 g from the Internal volume and the packing density of the mold, this amount of the alloy powder was charged into a space defined by the mold and the spacer. A sectional view of the mold immediately after charging the alloy powder 20 is shown in FIG. 3.

(Filling Step)

Flat bottom push-in punch member (flat bottom punch) 22 with flat bottom face was inserted into an opening of the powder feeding spacer 21, and this was dropped on the pedestal not shown with the powder feeding spacer 21 set on the mold having the powder filled 5 times from a height of 5 an to bump the mold bottom plate 13 against the pedestal, and the powder was packed until a bottom face of the flat bottom punch reached about 2 mm above the mold. This state is shown in FIG. 4.

Next, using a push-in punch member with grooves (punch with grooves) which is provided with grooved 23 at the positions corresponding to a top end of the partition, the mold was dropped 5 times from a height of 5 cm as with the above, and filling was completed when all of the alloy powder is housed in the mold. The bulk density of the alloy powder at this time was 3.6 g/cm$^3$, and a section view of the mold at this time is shown in FIG. 5.

The weight of the punch member at this time was 240 g and a filled area was 10 cm$^2$. The filled molded-body was thus prepared. In addition, the above-mentioned pressing force was estimated by comparison between the case of pressing by a punch and the case of pressing by an air cylinder, a pressure and a sectional area of the air cylinder.

(Orienting Step)

The powder feeding spacer and the punch were removed and a lid plate 16 is attached to a top surface of the mold using a screws. The mold housing the filled molded-body was moved to the inside of a coil for magnetic orientation. A pulsed magnetic field of 4 tesla was applied in a direction perpendicular to the partition. A sectional view of the mold at this time is shown in FIG. 6. An arrow at the bottom of FIG. 6 indicates a direction of a magnetic field. A magnet alloy powder in the filled molded-body was oriented to form a oriented filled-molded-body.

(Retrieving Step)

The side walls constituting the mold are detached from the oriented filled-molded-body of the magnet alloy powder, and a stacked block of the oriented filled-molded-body with a magnet and the partitions is retrieved from the mold. First, a lid plate of the mold was removed and then side plates 11 were retrieved. FIG. 7 upper drawing is a view of the mold in this situation viewed from above. Subsequently end plates 12 were retrieved. FIG. 7 lower drawing is a view of the mold in this situation viewed from above. In these drawings, a rectangular plate visible under the side walls is a bottom plate arranged at the underside of the mold side-walls. When the side plates and the end plates are removed, the stacked block of the oriented filled-molded-body with a magnet and the partitions becomes a state of being placed on the bottom plate.

(Sintering Step)

The stacked block was shifted from on the bottom plate to on the pedestal and moved to the inside of the sintering furnace. The pedestal made of carbon was used. When the shift from on the bottom plate to on the pedestal is carried out carefully, the stacked block is not collapsed.

After the exhaust of the entire sintering furnace was carried out by a turbo-molecular pump, a temperature of the furnace was raised at a temperature raising rate of 1° C./min to 500° C. Thereafter, the temperature was raised at a temperature raising rate of 2° C./min to 1040° C. After the stacked block was maintained at this temperature for 4 hours, heating was stopped, and the stacked block was cooled to room temperature in the furnace. The Stacked block in which the oriented filled-molded-body has became a sintered body is gently pedestal with the bottom plate from the sintering furnace. Five sintered body on one pedestal were placed at regular intervals in proper alignment without falling down on the pedestal. Dimensions and weights of five sintered bodies were extremely close to one another. A photograph of the stacked block on the pedestal is shown in FIG. 8(*a*), and a photograph of a state in which the magnetic poles and the partitions were removed from the stacked block is shown in FIG. 8(*b*). Further, comparisons of weights, densities and dimensions of the five sintered bodies in this example are shown in Table 1. In this Table, the range (%) refers to a value obtained by multiplying (Max−Min)/Max by 100, and the thickness refers to a thickness including warpage, if warpage occurs. Dimensions were measured with a vernier caliper.

In Table 2, measurements of magnetic characteristics (coercive force, maximum energy product, remanent flux characteristic) of sintered bodies of cavities No. 2 and No. 3 are shown. These characteristics are almost equal to those of a magnet of maximum quality obtained by a transverse-field pressing method.

TABLE 1

Weight and Dimension of Sintered Body

| Cavity No. | Weight (g) | Density (g/cm3) | Dimension: Longer side (mm) | Dimension: Shorter side (mm) | Dimension: Thickness (mm) |
|---|---|---|---|---|---|
| 1 | 13.08 | 7.59 | 34.11 | 16.99 | 3.05 |
| 2 | 13.29 | 7.59 | 34.14 | 17.05 | 3.09 |
| 3 | 13.37 | 7.60 | 34.18 | 17.06 | 3.05 |
| 4 | 13.15 | 7.59 | 34.16 | 17.05 | 3.08 |
| 5 | 13.04 | 7.57 | 34.09 | 17.01 | 3.05 |
| Range % | 2.4 | 0.4 | 0.3 | 0.4 | 1.3 |

TABLE 2

Magnetic Characteristics

| Cavity No. | Coercive force [kOe] | Maximum Energy Product BHmax [MGOe] | Remanent Flux Density Br [kG] |
|---|---|---|---|
| 2 | 20.2 | 43.8 | 13.5 |
| 3 | 20.4 | 43.5 | 13.3 |

[Rationalization of Production Process]

It is important in actuality to save wasteful expenditure and rationalize a production process.

An example of contriving how the bottom plate is used for several purposes will be described. In the present invention, the plate arranged at the underside of the mold side-walls is not required in all steps and is required in only the powder feeding step, the filling step and the orienting step. When moving the filled molded-body from the filling step to the orienting step, the filled molded-body can be conveyed even though the plate is not present. Therefore, the plate arranged at the underside of the mold side-walls in the powder feeding step and the filling step may be different from the plate arranged in the orienting step. That is, the bottom plate does not need to be conveyed when a bottom plate is always placed at a location of the powder feeding step and the filling step, and placed at a location of the orienting step. When doing in this way, the number of parts constituting the mold throughout all steps can be reduced resulting in a rationalization of steps.

Similarly, since the step in which the lid plate is absolutely required is only the orienting step, one bottom plate may be always kept at the orienting step and used for several purposes.

Such a rationalization measures is not essential, and specifically there are various rationalization measures.

Example 2

Using a resin plate having the same size in place of the magnetic poles of Example 1, the effect of the magnetic pole was examined. When the magnetic pole is not used, the magnetic field at the orienting step is slightly deviated from a uniform magnetic field and the orientation of the oriented filled-molded-bodies at both ends is disturbed. The effect of the disturbance was examined.

The respective steps were performed in the same manner as in Example 1 except that using a resin plate, powder feeding/filling/orienting steps were performed and the resin plate was removed before the sintering step. Further, comparisons of weights, densities and dimensions of the five sintered bodies after sintering are shown in Table 3. In this Table, as with Example 1, the range (%) refers to a value obtained by multiplying (Max−Min)/Max by 100, and the thickness refers to a thickness including warpage, if warpage occurs.

TABLE 3

Weight, Dimension and Variation without Magnetic poles

| Cavity No. | Weight [g] | Density [g/cm3] | Dimension Longer side [mm] | Shorter side [mm] | Thickness [mm] |
|---|---|---|---|---|---|
| 1 | 13.17 | 7.55 | 34.05 | 17.07 | 3.13 |
| 2 | 13.04 | 7.59 | 34.25 | 17.06 | 3.18 |
| 3 | 13.26 | 7.60 | 34.29 | 17.13 | 3.17 |
| 4 | 13.07 | 7.60 | 34.16 | 17.06 | 3.12 |
| 5 | 13.25 | 7.59 | 34.07 | 17.06 | 3.16 |
| Range % | 1.7 | 0.7 | 0.7 | 0.4 | 1.9 |

Comparing Table 1 with Table 3, it is found that thicknesses of the sintered bodies at both ends are significantly large in Table 3. This thickness includes warpage, and it is visually found that the sintered bodies at both ends are warped. That is, it is found that when the magnetic pole is not used, the magnetic field does not become uniform in the orienting step, the sintered body is warped by the amount. However, it is found that in accordance with the present invention, a thin-shaped magnet having high magnetic characteristics and dimensional variation is small can be produced even though the magnetic pole is not used. When the magnetic pole is used, the dimensional variation is reduced a little.

Example 3

The stacked block 27 is placed with the bottom plate 13 on the pedestal 25, and other operations were carried out in the same manner as in Example 1. The result substantially agrees with that of Example 2. This state is shown in FIG. 9.

When the bottom plate is made of a material which is not damaged in the sintering step and does not react with the alloy powder, the stacked block may be sintered with the bottom plate. This way is more safe particularly when strength of the oriented filled-molded-body is not adequate since the stacked block of the oriented filled-molded-body of the alloy powder does not need to move from the bottom plate to the pedestal.

Example 4

After the orienting step, the stacked block was dissected out, partitions and the magnetic poles were removed, and only the filled molded-body of the alloy powder was sintered. Other steps were performed in the same manner as in Example 1. This method can be applied to only the case in which the filled molded-body is firmly solidified after orientation and a shape of the oriented filled-molded-body is not collapsed even when removing the partitions. Only the filled molded-body 26 was placed on the pedestal 25 and sent to the sintering step. The drawing of this is shown in FIG. 10. By sintering the molded body of FIG. 10, the same results as in Example 1 were obtained.

Example 5

Example 2 was an example of production of a flat plate-shaped rectangular sintered body. In the present example, an arc segment plate-like sintered body was produced in the same manner as in Example 2. A magnetic pole was not used. A view of the post-filling step mold viewed from above is shown in FIG. 11. In this case, the partition needs to be formed into an arc segment plate-shape as with a product. A silicon steel plate of 0.5 mm in thickness was heated at 500° C. for 1 hour, and then punched out by pressing to prepare partitions. Five arc segment-shaped sintered bodies could be prepared with the same high dimensional precision as in Example 2 by sintering the oriented filled-molded-body of the alloy powder in the same manner as in Example 2.

Example 6

Example 2 was an example of production of a flat plate-shaped rectangular sintered body. In the present example, a sectorial flat plate-like sintered body was produced in the same manner as in Example 2. A magnetic pole was not used. A view of the post-filling step mold is shown in FIG. 12. A view on a left side is a view of the mold viewed from above, and a view on a right side is a sectional side view of the mold.

Also in this case, the same results as in Example 1 were obtained by sintering the oriented filled-molded-body of the alloy powder in the same manner as in Example 2.

Example 7

An assembled mold having 30 cavities was prototyped. A sectional view of the prototyped mold into which 20 g of an alloy powder was filled is shown in FIG. 13.

A size of a cavity was set to 26 mm×22 mm×4.6 mm, a thickness of the partition was set to 0.5 mm, and a whole length of the mold was about 240 mm including end plats and magnetic poles.

FIG. 14 shows a cross-section structure of a connecting portion positioned at both ends of the mold of FIG. 13, and two tensile springs with a tensile force of about 2 kg which are provided at both ends of the mold, is connected between the end plate and the end plate. Four taper pins are provided in the end plate, and 2 side pates are exactly connected to 2 end plates by fitting in a pin hole provided at a corresponding position in the side plate to compose a side wall of the mold (Refer to an upper drawing of FIG. 14).

A lower drawing of FIG. 14 is a view showing a state at the time of opening the mold. The mold is lifted by picking up four corners at both end of the mold by a retrieving movable member having clicks, disposed in the conveying device, conveyed (the bottom plate is not conveyed), and transferred to a stripping position and placed on a base plate. If the clicks of the conveying device are opened in a direction in which the side plate moves away from the end plate, the stacked block within the mold is separated from the side plate. If the clicks are further opened to a taper portion of the taper pin, the end plates can also moves away from the stacked block by the compression spring.

When the mold is moved upward in this state, the stacked block is left on the base plate and can be retrieved from the mold.

It was verified that 30 sintered bodies can be simultaneously obtained by one mold by preparing a stacked block of the oriented filled-molded-body of the magnet alloy powder based on this mold, and sintering the stacked block in the same manner as in Example 1. In this time, the dimensional accuracy and the magnetic characteristics were also good as with Example 1.

Example 8

An example of the production device 30 is shown in FIG. 15. In this drawing, a mold assembling device 31 is also placed in one chamber filled with an inert gas as with other devices. It is illustrated that in this example, mold parts to be assembled in the mold assembling device are supplied from the outside of the device through a supplying portion 36; however, it is favorable to use the conveying device within the production device since this does not need the closing and opening of the chamber.

In this example, the sintering furnace 35 is disposed in another chamber, and these chambers are connected to each other with an airtight passage smaller in a diameter than these chambers. If an openable and closable door is provided in the airtight passage, the stacked block of the oriented filled-molded-body and the partitions can be conveyed from a left side to a right side of FIG. 15 through the door, and the sintering step can be performed in a vacuum by closing the door.

Example 9

Example of Specific Structure of Production Device of Magnetic Anisotropic Rare Earth Sintered Magnet of the Present Invention FIG. 16 shows an example of a structure in a preferred example of the production device of the present invention.

The production device is composed of a partition built-in device (mold assembling device), a powder feeding/filling device, a conveying device 1 and a conveying device 2, and operated in a nitrogen atmosphere within a globe box covering the whole device, all steps were performed in a nitrogen atmosphere, and a size of the glove box accommodating the partition built-in device, and the powder feeding/filling device was, for example, 2.5 m×1 m×1 m.

The orienting device is placed at a position distance from the partition built-in device and the powder feeding/filling device in order to reduce the magnetic field leakage, but it is placed in a chamber communicated with a chamber which houses these devices, and in a nitrogen atmosphere as with these devices.

The number of the molds is 4 in total (1 for in the partition built-in (mold assembling) device, 1 for in the powder feeding/filling device, 1 for in the orienting device, and 1 for a waiting position prior to the partition built-in device). In addition, in FIG. 16, a function of retrieving the filled molded-body of the alloy powder from the mold and a function of cleaning (gas blowing) the powder adhered to the mold are incorporated into the conveying device 2.

In this device, many partitions loaded in a magazine are supplied from the partition supply port, and build in the mold one by one in the partition built-in device, and a raw material powder loaded in a powder container (not shown) is supplied from a connection portion at the upper portion of the powder feeding/filling device.

The mold used has dimensions described in FIG. 13, and the number of the cavities is set to 30.

Then, a block (referred to as a magazine) composed of 31 stainless steel partitions having a thickness of 0.5 mm overlaid is continuously supplied from partition supply port.

In the partition built-in device, the partition is directly drawn from the magazine one by one and inserted into the mold formed of the side plates and the end plates to complete arrangement of 30 partitions within one minute.

Next, a process of the present device illustrated in FIG. 16 will be described.

In the partition built-in device, the partition is inserted in the mold side wall.

The mold having the partitions attached to the side wall is conveyed to the powder feeding/filling device by the conveying device 1. The conveying device 1 is provided with an underlay in order to avoid falling of the partition during conveying. The bottom plate arranged at the underside of the mold side-walls is prepared in the powder feeding device.

A spacer is disposed in the powder feeding/filling device, and to a bottom face of the spacer, the mold is joined to feed the alloy powder, and subsequently filling is performed.

After the powder feeding/filling, the mold housing the filled molded-body is conveyed to a relay point of the orienting device by the conveying 1 and conveying 2 (a bottom plate of the mold is not conveyed). A lower plate is provided on a conveyor of the orienting device, and the mold housing the filled molded-body is placed thereon and conveyed to a center of a coil by the conveyor.

An upper plate is provided above the orienting coil in order to prevent scattering of the alloy powder in orientation, and a pulsed magnetic field magnetic field of 4 tesla was applied with the upper plate pressed against the mold to align directions of particles of the alloy powder in the mold to improve magnetic characteristics.

After completion of the orientation, the mold housing the stacked block is returned to the relay point by the conveyor, and carried out from the orienting device by the conveying device 2.

The stacked block is stripped off the mold by a function incorporated into the conveying device 2.

The stripped stacked block is conveyed out of the glove box through a sintering furnace connection port by a round trip mechanism and conveyed to the inside of the sintering furnace.

The mold after stripping is returned to the waiting position prior to the partition built-in device by conveying 1 after cleaning fine powder adhering to the mold by air blowing by a function incorporated into conveying 2. In addition, when the partition is not built in the mold, the stripped mold is conveyed to the powder feeding device and reused.

In the present device, four molds were used.

A processing ability of the present device was 58 seconds per mold.

Using the alloy powder for a NdFeB sintered magnet (composition of the alloy is described in the paragraph [0076]) obtained by the production method described in the paragraph [0051], 30 sintered bodies were prepared by following the same steps as in Example 1 by the production device of the present invention shown in FIG. 16. Weights, densities and dimensions of the 30 sintered bodies thus prepared are shown in Table 4 and the magnetic characteristics of the sintered bodies of the cavities No. 16 to 25 are shown in the following Table 5.

TABLE 4

Weight and Dimension of Sintered Body

| Cavity No. | Weight (g) | Density (g/cm3) | Longer side (mm) | Shorter side (mm) | Thickness (mm) |
|---|---|---|---|---|---|
| 1 | 9.00 | 7.53 | 22.12 | 18.64 | 2.84 |
| 2 | 8.98 | 7.54 | 22.20 | 18.44 | 2.85 |
| 3 | 8.94 | 7.54 | 22.18 | 18.63 | 2.86 |
| 4 | 8.91 | 7.54 | 22.14 | 18.56 | 2.84 |
| 5 | 8.95 | 7.54 | 22.16 | 18.61 | 2.86 |
| 6 | 8.97 | 7.54 | 22.19 | 18.61 | 2.85 |
| 7 | 8.97 | 7.54 | 22.21 | 18.65 | 2.85 |
| 8 | 8.96 | 7.54 | 22.21 | 18.59 | 2.84 |
| 9 | 8.93 | 7.54 | 22.24 | 18.62 | 2.86 |
| 10 | 8.85 | 7.54 | 22.28 | 18.55 | 2.86 |
| 11 | 8.89 | 7.54 | 22.27 | 18.62 | 2.85 |
| 12 | 8.99 | 7.54 | 22.29 | 18.62 | 2.86 |
| 13 | 8.99 | 7.54 | 22.26 | 18.56 | 2.85 |
| 14 | 8.99 | 7.54 | 22.28 | 18.56 | 2.85 |
| 15 | 8.84 | 7.54 | 22.23 | 18.50 | 2.83 |
| 16 | 8.84 | 7.53 | 22.21 | 18.43 | 2.81 |
| 17 | 8.87 | 7.53 | 22.20 | 18.39 | 2.81 |
| 18 | 8.87 | 7.54 | 22.18 | 18.48 | 2.82 |
| 19 | 8.74 | 7.54 | 22.26 | 18.40 | 2.82 |
| 20 | 8.88 | 7.53 | 22.26 | 18.47 | 2.82 |
| 21 | 8.88 | 7.54 | 22.21 | 18.41 | 2.82 |
| 22 | 8.86 | 7.54 | 22.21 | 18.45 | 2.84 |
| 23 | 8.83 | 7.53 | 22.17 | 18.44 | 2.81 |
| 24 | 8.84 | 7.54 | 22.23 | 18.49 | 2.85 |
| 25 | 8.87 | 7.54 | 22.16 | 18.52 | 2.83 |
| 26 | 8.86 | 7.54 | 22.18 | 18.53 | 2.84 |
| 27 | 8.84 | 7.54 | 22.20 | 18.53 | 2.85 |
| 28 | 8.84 | 7.54 | 22.16 | 18.49 | 2.82 |
| 29 | 8.85 | 7.54 | 22.10 | 18.51 | 2.82 |
| 30 | 8.95 | 7.53 | 22.07 | 18.64 | 2.82 |
| Range % | 2.8 | 0.1 | 1.0 | 1.4 | 1.8 |

TABLE 5

Magnetic Characteristics

| Cavity No. | Coercive force [kOe] | Maximum Energy Product BHmax [MGOe] | Remanent Flux Density Br [kG] |
|---|---|---|---|
| 16 | 12.1 | 50.1 | 14.3 |
| 17 | 12.3 | 48.5 | 14.2 |
| 18 | 12.2 | 48.6 | 14.1 |
| 19 | 12.4 | 48.3 | 14.0 |
| 20 | 12.2 | 49.2 | 14.1 |
| 21 | 12.2 | 49.6 | 14.1 |
| 22 | 12.1 | 50.0 | 14.3 |
| 23 | 12.2 | 49.3 | 14.1 |
| 24 | 12.0 | 51.0 | 14.4 |
| 25 | 12.4 | 49.8 | 14.0 |

In the example, a powder having an average particle size of 4.1 μm was prepared from an alloy whose weight ratio is 27.0% of Nd, 4.8% of Pr, 0.95% of Co, 0.99% of B, 0.25% of Al, 0.08% of Cu, and rest of Fe, and used for experiments. Values of the magnetic characteristics described in Table 5 can be determined to be high similar to those of an alloy powder according to a transverse-field molding method among Nd—Fe—B sintered magnets which are obtained by preparing an oriented molded-body from composition of the alloy and a particle size of the alloy powder used in the present example using a conventional press method and sintering/heat treating the oriented molded-body. It is impossible to prepare the thin-shaped sintered body of 3 mm in thick like the present example by the transverse-field pressing method. It was verified that according to the production method of the present invention, 30 thin-shaped Nd—Fe—B sintered magnets which have high characteristics equal to those of Nd—Fe—B sintered magnet prepared by the transverse-field pressing method, are simultaneously prepared, and that thin-shaped Nd—Fe—B sintered magnet has high magnetic characteristics and small variation. Thereby, it was verified that the production method of the present invention is useful as a technology of directly producing, without a cutting step and with high productivity, the thin-shaped Nd—Fe—B sintered magnet which has high magnetic characteristics equal to the transverse-field pressing method, and variation of the and dimensional variation are small.

DESCRIPTION OF REFERENCE SIGNS

10 Assembled mold
11 Side plate
12 End plate
13 Bottom plate
14 Partition
15 Magnetic pole
16 Lid plate
20 Alloy powder
21 Powder feeding spacer
22 Flat bottom push-in punch member (flat bottom punch)
23 Push-in punch member with grooves (punch with grooves)
25 Sintering pedestal
26 Oriented filled-molded-body
27 Stacked block
30 Production device of a rare earth sintered magnet
31 Mold assembling device (partition built-in device)
32 powder feeding/filling device
33 Orienting device
34 Retrieving part of an oriented filled-molded-body
35 Sintering furnace
36 Supplying part of mold parts or partitions
37 Supplying part of an alloy powder

The invention claimed is:

1. A method for producing a magnetic anisotropic rare earth sintered magnet comprising:

a powder feeding step of feeding an alloy powder into a mold having side walls divided into two or more sections;

a filling step of filling the alloy powder into the mold to prepare a filled molded-body;

an orienting step of orienting the alloy powder in the filled molded-body by applying a magnetic field to the filled molded-body to prepare an oriented filled-molded-body;

a retrieving step of detaching the side walls of the mold from the oriented filled-molded-body and retrieving the oriented filled-molded-body from the mold; and a sintering step of sintering the retrieved oriented filled-molded-body, wherein the filling step and the orienting step are performed at different locations, and wherein the mold is not carried in the sintering step.

2. The method for producing a magnetic anisotropic rare earth sintered magnet according to claim 1, wherein one or plural removable partitions is built in the inside of the mold and the inside of the mold is partitioned into a plurality of cavities by the partitions.

3. The method for producing a magnetic anisotropic rare earth sintered magnet according to claim 2, wherein a partition built-in step is provided prior to the powder feeding step.

4. The method for producing a magnetic anisotropic rare earth sintered magnet according to claim 1, wherein a powder feeding spacer is placed on the mold and a predetermined amount of an alloy powder is charged into a space defined by the mold and the powder feeding spacer in the powder feeding step.

5. The method for producing a magnetic anisotropic rare earth sintered magnet according to claim 4, wherein one powder feeding spacer capable of feeding the alloy powder to one or plural cavities of the mold is disposed.

6. The method for producing a magnetic anisotropic rare earth sintered magnet according to claim 5, wherein in the filling step, a push-in punch member for housing all of the predetermined amount of the alloy powder charged into a space defined by the mold and the powder feeding spacer within the mold, is placed above the mold, and in this state, the mold is dropped repeatedly from a certain height, and thereby all of the alloy powder is housed within the mold and a density of the alloy powder is increased.

7. The method for producing a magnetic anisotropic rare earth sintered magnet according to claim 2, wherein the oriented filled-molded-body is retrieved together with the partitions in one united body in the retrieving step.

8. The method for producing a magnetic anisotropic rare earth sintered magnet according to claim 1, wherein the powder feeding step and the filling step of the respective steps are performed at the same location, and the powder feeding step/the filling step, the orienting step, the retrieving step, and the sintering step are respectively performed at different locations.

9. The method for producing a magnetic anisotropic rare earth sintered magnet according to claim 1, wherein the powder feeding step, the filling step, the orienting step and the retrieving step are performed in a single chamber or plural chambers communicated with one another, and inside of the single or plural chamber is filled with an inert gas.

10. The method for producing a magnetic anisotropic rare earth sintered magnet according to claim 9, wherein the partition built-in step is performed prior to the powder feeding step, and the partition built-in step and the powder feeding step are performed in the same chamber.

11. The method for producing a magnetic anisotropic rare earth sintered magnet according to claim 1, wherein the mold is composed of side walls consisting of two side plates and two end plates, and one bottom plate.

12. The method for producing a magnetic anisotropic rare earth sintered magnet according to claim 1, wherein magnetic poles are provided at both internal ends of the mold.

13. The method for producing a magnetic anisotropic rare earth sintered magnet according to claim 12, wherein the oriented filled-molded-body is retrieved together with the partitions and the magnetic poles in the retrieving step.

14. The method for producing a magnetic anisotropic rare earth sintered magnet according to claim 7, wherein the oriented filled-molded-body is sintered together with the partitions in the sintering step.

15. The method for producing a magnetic anisotropic rare earth sintered magnet according to claim 13, wherein the oriented filled-molded-body is sintered together with the magnetic poles in the sintering step.

16. The method for producing a magnetic anisotropic rare earth sintered magnet according to claim 12, wherein the oriented filled-molded-bodies are taken off from the partitions/the magnetic poles and discretely sintered.

17. The method for producing a magnetic anisotropic rare earth sintered magnet according to claim 8, wherein in the retrieving step, the mold from which the oriented filled-molded-body has been retrieved is conveyed to the partition built-in step or the powder feeding step and reused.

18. The method for producing a magnetic anisotropic rare earth sintered magnet according to claim 1, wherein a magnetic field applied in the orienting step is a pulsed magnetic field.

* * * * *